US005260750A

United States Patent [19]

Ishida et al.

[11] Patent Number: 5,260,750

[45] Date of Patent: Nov. 9, 1993

[54] IMAGE FORMING APPARATUS HAVING INTEGRAL DEVELOPING AGENT STORING AND REMOVING CONTAINERS

[75] Inventors: Takao Ishida, Yokohama; Naofumi Miyasaka, Tokyo, both of Japan

[73] Assignee: Kabushiki Kaisha Toshiba, Kawasaki, Japan

[21] Appl. No.: 857,495

[22] Filed: Mar. 25, 1992

[30] Foreign Application Priority Data

Jun. 21, 1991 [JP] Japan ..... 3-150575

[51] Int. Cl.[5] ..... G03G 15/00

[52] U.S. Cl. ..... 355/260; 355/200; 355/245

[58] Field of Search ..... 355/200, 210, 245, 260, 355/296-298; 118/689-691; 222/DIG. 1

[56] References Cited

U.S. PATENT DOCUMENTS 4,768,055 8/1988 Takamatsu et al. ..... 355/200 X
4,771,313 9/1988 Kuroda et al. .
4,894,688 1/1990 Tamiguchi et al. ..... 355/298
4,963,940 10/1990 Nemoto et al. ..... 355/260
5,017,962 5/1991 Tsuji et al. ..... 355/210
5,017,966 5/1991 Suga ..... 355/260
5,047,801 9/1991 Haneda et al. ..... 355/200
5,065,195 11/1991 Haneda et al. ..... 355/298

*Primary Examiner*—A. T. Grimley
*Assistant Examiner*—Thu Dang
*Attorney, Agent, or Firm*—Foley & Lardner

[57] ABSTRACT

An image forming apparatus includes a toner processing unit which is detachably fitted to a cleaning device and a developing unit arranged in the apparatus body. The unit has first and second container integrated with each other. The first container defines a storing portion storing toner which is to be supplied to the developing unit. The second container defines a recovery portion for receiving waste toner removed by the cleaning means. The storing portion and recovery portion are partitioned from each other by a partitioning wall of the unit. The partitioning wall has a through-hole through for introducing, when the amount of the developing agent received into the recovery portion exceeds a capacity of the recovery portion, an excess part of the developing agent into the storing portion.

9 Claims, 12 Drawing Sheets

IMAGE FORMING APPARATUS HAVING INTEGRAL DEVELOPING AGENT STORING AND REMOVING CONTAINERS

BACKGROUND OF THE INVENTION

1. Field of the Invention

The present invention relates to an image forming apparatus for forming an image in an electronic photographing process using a laser printer, etc.

2. Description of the Related Art

Generally, image forming apparatuses include an electronic photographic process unit which performs the steps of charging, exposure, development, transfer, peeling, cleaning, and the like. An image is transferred on a paper sheet by passing the sheet through the image transfer section of the process unit, and is fixed to the sheet by passing the sheet between a pair of fixing rollers.

This type of conventional image forming apparatus employs a cartridge type developer ("toner") supply container for supplying toner to a developing device built in the apparatus body, as disclosed in U.S. Pat. No. 5,017,966, for example. The supply container is removably fitted to the apparatus body and detachably connected to the developing device.

Untransferred toner, which has not been transferred on the paper sheet at the image transfer section, is removed from a photoconductive body by a cleaning device. The removed toner is brought to the outside of the process unit and is collected in a cartridge type recovery container. The recovery container is also detachably fitted to the process unit.

When the "empty" state of the toner supply container and the "full" state of the recovery container are detected by a detector, the operator exchanges the containers on the basis of the detection result.

In conventional apparatuses, the toner supply container and the toner recovery container are separated, or, in order to simplify the exchange process, the containers are integrated with the process unit, as disclosed in U.S. Pat. No. 4,771,313.

In the former case, however, the containers must be independently exchanged each time the toner is supplied or the used toner is dumped. This is troublesome.

In the latter case, the exchange operation can be simplified; however, the storage amounts of supply toner and used toner are limited, owing to the practical size of the integrated process unit. Consequently, the exchange cycle of the entire unit is shortened, and the unit must be exchanged earlier than the end of the lifetime of the relatively expensive developing device, cleaning device and photoconductive drum. Thus, the running cost of the apparatus increases.

SUMMARY OF THE INVENTION

The present invention has been made in consideration of the above circumstances, and its object is to provide an image forming apparatus wherein a developing agent supply container and a storage container can be easily attached to and detached from the image forming apparatus, the frequency of maintenance by the user is low, the running cost is low, and the leakage of developing agent can be prevented.

In order to achieve the above object, there is provided an image forming apparatus which comprises: means for developing a latent image formed on an image carrier, by using a developing agent; means for transferring the developed image onto a recording medium; means for removing the developing agent remaining on the image carrier after the image transfer by the transferring means; and a developing agent processing unit detachably fitted to the developing means and the removing means. The processing unit includes: a storing portion storing a developing agent; means for supplying the developing agent in the storing portion to the developing means; a recovery portion for storing the developing agent removed by the removing means; and means for introducing part of the developing agent in the recovery portion into the storing portion, when the developing agent removed by the removing means exceeds the capacity of the recovery portion.

According to this image forming apparatus, the developing agent processing unit has the storing portion and a recovery portion, which are integrated as one body. Thus, the processing unit can be exchanged singly, and, compared to the conventional apparatus having a separate supply container and recovery container, the exchange procedure is easy. In addition, when the amount of the developing agent recovered in the recovery portion exceeds the capacity thereof, the excess portion of the developing agent is introduced into the storing portion. Thus, the recovery portion is not filled with the developing agent and the function of the removing means is not prevented. Further, the developing agent in the recovery portion does not leak to the inside of the apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 17 show a laser printer according to an embodiment of the present invention, in which:

FIG. 1 is an exploded perspective view showing a developing device, cleaning device, and developing agent processing unit of the printer;

FIG. 2 is a longitudinal-sectional view of the processing unit;

FIG. 3 is an enlarged sectional view showing the portion shown in FIG. 2 in a dot-and-dash line circle A;

FIG. 4 is a sectional view taken along line 4—4 in FIG. 2;

FIG. 5 is an exploded perspective view illustrating the processing unit;

FIG. 6 is a sectional view showing a waste toner stirring mechanism;

FIG. 7 is a front view of the processing unit;

FIG. 8 through FIG. 10 are enlarged sectional views showing the different operation states of the essential parts of first and second shutter mechanisms;

FIGS. 11 is a sectional view showing the connecting portions of the cleaning device and the processing unit just before they are connected to each other;

FIG. 12 is a sectional view taken along line 12—12 in FIG. 7, showing the cleaning device and processing unit connected to each other;

FIG. 13 shows an external appearance of the laser printer;

FIG. 14 is a sectional view schematically showing the internal structure of the laser printer;

FIG. 15 is a perspective view showing the printer in the state wherein the top cover of the printer is opened;

FIG. 16 is a perspective view showing the printer in the state wherein the top cover of the printer is opened, viewed from a direction different from FIG. 15; and FIG. 17 is a perspective view showing a process of setting the processing unit to the printer.

DETAILED DESCRIPTION OF THE PREFERRED EMBODIMENT

An embodiment of the present invention will now be described with reference to the accompanying drawings.

Figure 13:
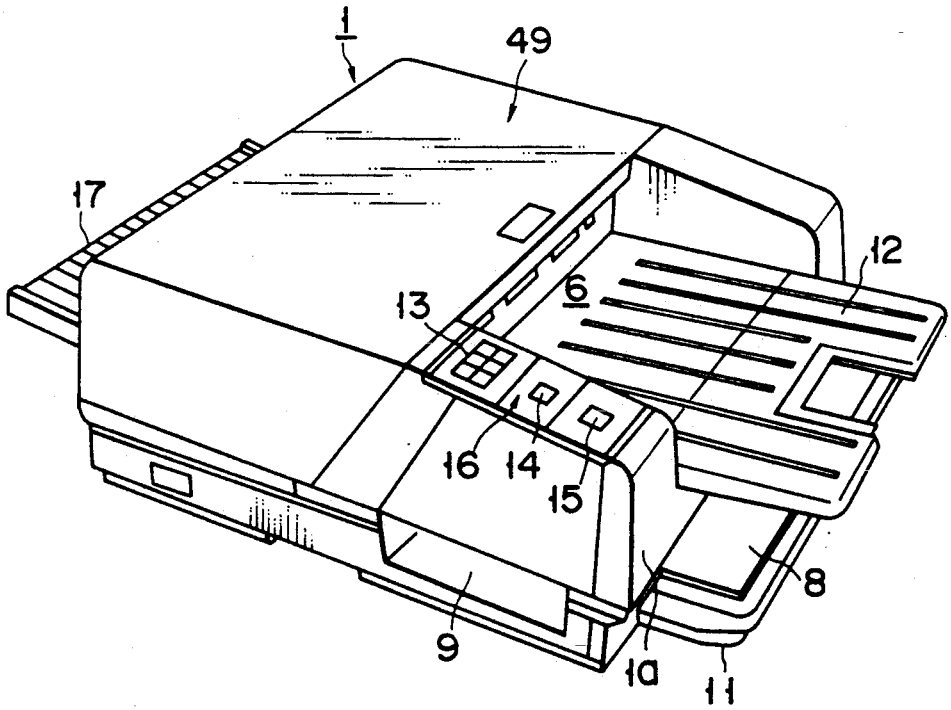

FIG. 13 shows the external appearance of a laser printer functioning as an electronic photographing type image forming apparatus using a semiconductor laser.

Figure 14:
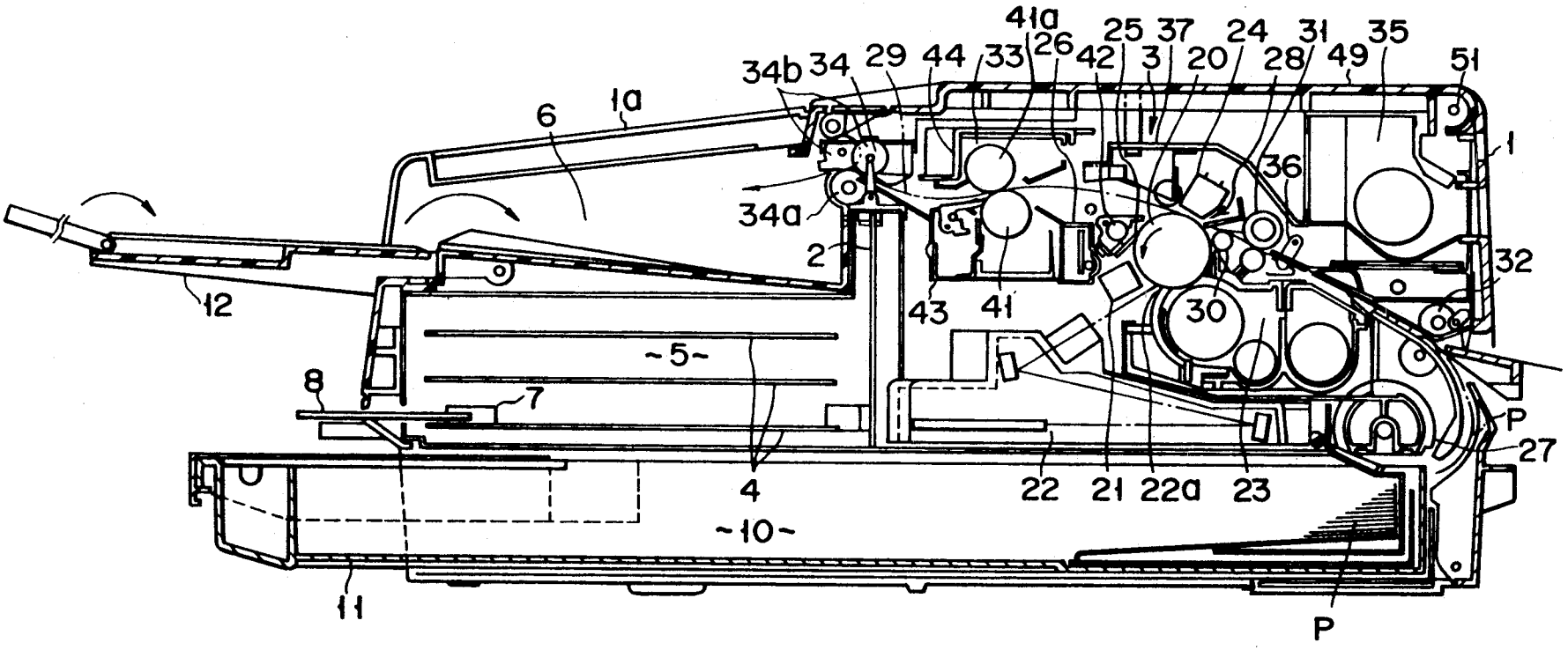

FIG. 14 shows the internal structure of the laser printer.

The laser printer is connected to an external output device (or a host system, not shown) such as a computer or a word processor via a transmission controller such as an interface circuit. Upon receiving a print start signal from the host system, the laser printer starts an image forming operation and records an image on a paper sheet (the medium on an image is to be transferred). Thus, the recorded image is output.

As is shown in FIGS. 13 and 14, the printer comprises an apparatus body 1. A main control board 2 is provided at a center part of the inside of the body 1. An electronic photographing process unit 3 for forming an image is disposed in the rear of the main control board 2 (on the right side in FIG. 13). A control board storage section 5 for containing a plurality of function-adding control boards 4 is defined in front of, and under, process unit 3. A paper discharge section 6 is defined in front of, and above, storage section 5.

The storage section 5 is capable of containing three function-adding control boards 4 at a maximum. For example, the kinds of Chinese "Kanji" characters can be increased by employing the boards 4. A front edge portion of the lowermost control board 4 is provided with an IC card connector 7. A function-adding IC card 8 can be connected to the connector 7, thereby increasing the number of functions. A left end portion of the lowermost control board 4 is provided with two interfaces (not shown). The two interfaces are opposed to an opening 9 (FIG. 13) formed in the left side portion of the apparatus body 1. A cassette storing section 10 for receiving a paper cassette 11 is defined at a lower part in the apparatus body 1.

The paper discharge section 6 has a recess formed in a front-side upper part of the apparatus body 1, and a paper tray 12 provided at a front edge portion of the recess. The paper tray 12 is rotatable in the direction of arrows shown in FIG. 14. The size of the paper discharge section 6 can be adjusted in accordance with the size of a discharged paper sheet P, by folding and unfolding the tray 12.

A control panel 16 is provided on an upper surface of a left frame portion la of the body 1, which is situated on the left of the paper discharge section 6. The control panel 16 has a display LED 13, a two-digit display segment 14 and a switch 15. A manual paper feed tray 17 is mounted on the rear end portion of the body 1.

The structure of the electronic photographing process unit 3, which carries out electronic photographing processes, such as charging, exposure, development, transfer, peeling and cleaning, will now be described with reference to FIG. 14. The unit 3 includes a drum-shaped photoconductive body 20 functioning as an image carrying body. The body 20 is situated at an almost center area of a unit container in the body 1. Around the photoconductive body 20 are provided a charger 21 constituted by a Scorotron, an exposure portion 22*a* of a laser exposure unit 22 functioning as an electrostatic latent image forming means, a magnetic brush type developing unit 23 for a developing process, a transfer charger 24 constituted by a Scorotron, a cleaning blade 25 formed of rubber, for removing untransferred toner, and a pre-exposure device 26, in the rotating direction of the body 20.

In FIG. 14, numeral 29 denotes a paper convey path defined in the apparatus body 1. Paper P fed from the paper cassette 11 via a paper feeding mechanism 27 or paper P fed from the manual feed tray 17 is guided along the paper convey path 29 to the paper discharge section 6 through an image transfer section 28 which is defined between the photoconductive body 20 and the transfer charger 24. On the upstream side of the image transfer section 28 in the paper convey path 29, there are provided a pair of feed rollers 30, a pair of aligning rollers 31 and a pair of convey rollers 32. A fixing unit 33 and a paper discharge roller unit 34 are provided on the downstream side of the image transfer section 28 in the paper convey path 29.

In FIG. 14, numeral 35 denotes a cooling fan unit situated on the upper side of the convey rollers 32. An aligning switch 36 is provided near the aligning rollers 31. A convey guide 37 is provided near the image transfer section 28.

When a print start signal is supplied from the host system, the photoconductive body 20 rotates and the circumferential surface of the body 20 is uniformly charged by the charger 21. Then, a laser beam, which has been modulated on the basis of dot image data supplied from the host system, is caused to scan the photoconductive body 20 by use of the laser exposure unit 22. Thus, an electrostatic latent image corresponding to the image signal is formed on the photoconductive body 20. The electrostatic latent image on the photoconductive body 20 is developed into a visible image by the toner in a magnetic brush (not shown) of the developing unit 23.

In synchronism with the toner image forming operation, paper P picked up from the paper cassette 11 or inserted from the manual feed tray 17 is fed through the aligning rollers 31. The toner image on the photo-conductive body 20 is transferred to the paper P by means the transfer charger 24 at the transfer section 28. The paper P bearing the toner image is fed into the fixing unit 33 through the paper convey path 29, and the toner image is melted and fixed on the paper P. Then, the paper P is discharged into the discharge section 6 via the paper discharge roller unit 34. The toner remaining on the photoconductive body 20 after the toner image is transferred to the paper P is removed by the urethane rubber cleaning blade 25. The removed toner is conveyed to the outside of the process unit 3 by means of a convey spiral 42.

The fixing unit 33 comprises a heat roller 41 including a heater lamp, and a pressing roller 41a pressed against the heat roller 41. The paper P is passed between the rollers 41 and 41a functioning as fixing rollers, so that the toner image is melted and fixed on the paper P. The heat roller 41 and pressing roller 41a (are surrounded by a lower casing 43 and an upper casing 44 which ensure that heat does not leak to the outside and a desirable temperature for fixation may be maintained.

The paper discharge roller unit 34 comprises a lower roller 34a and an upper roller 34b. Along with a convey guide 37 and transfer charger 24, the upper half of the paper discharge roller unit 34, which includes the upper roller 34b, is attached to the lower surface of a top cover 49 of the apparatus body 1. The top cover 49 is rotatable about a support shaft 51 provided at an upper rear portion of the body 1.

Figure 15:
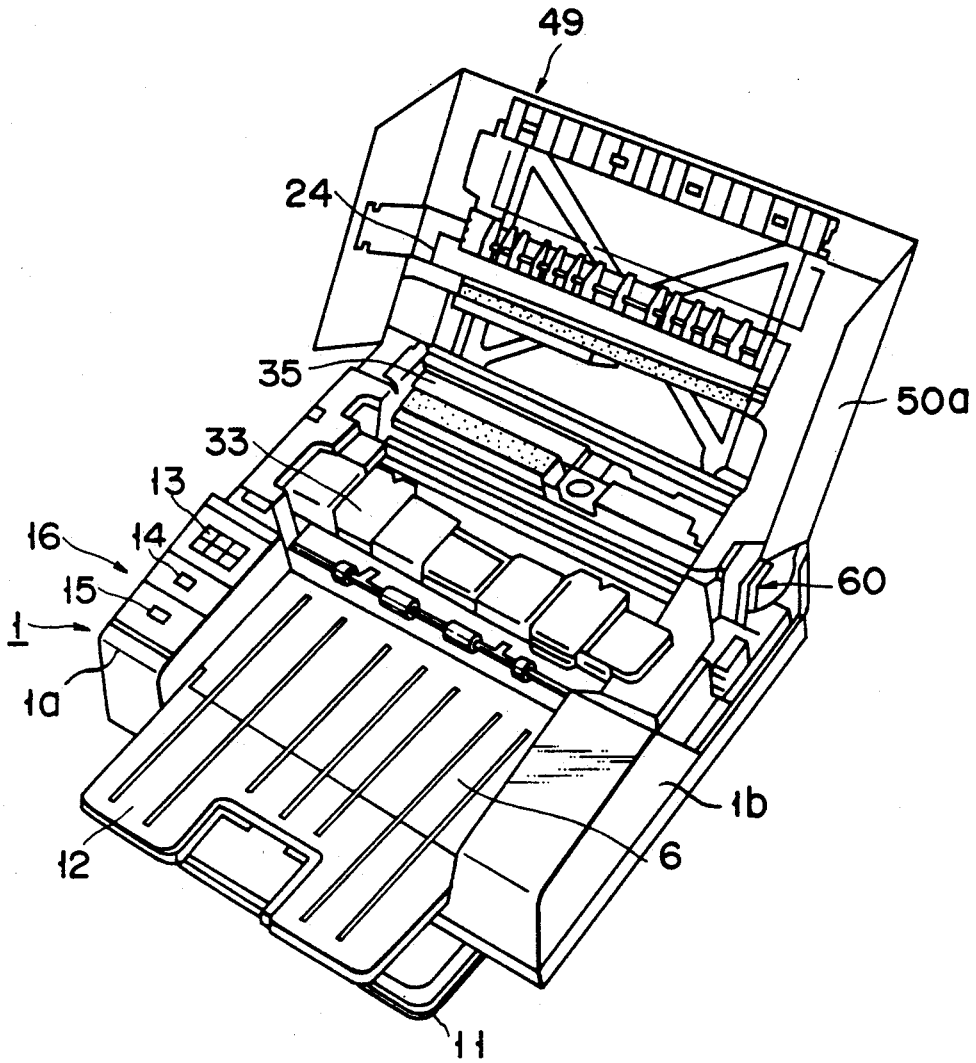

The top cover 49 can be opened at about 120°, (maximum), as show n FIG. 15. When the top cover 49 is opened, most of the paper convey path 29 and the devices opposed to path 29 are exposed, and any paper which is P jammed in path 29 can be easily removed. In addition, maintenance of the apparatus and exchange of parts is facilitated.

Figure 16:
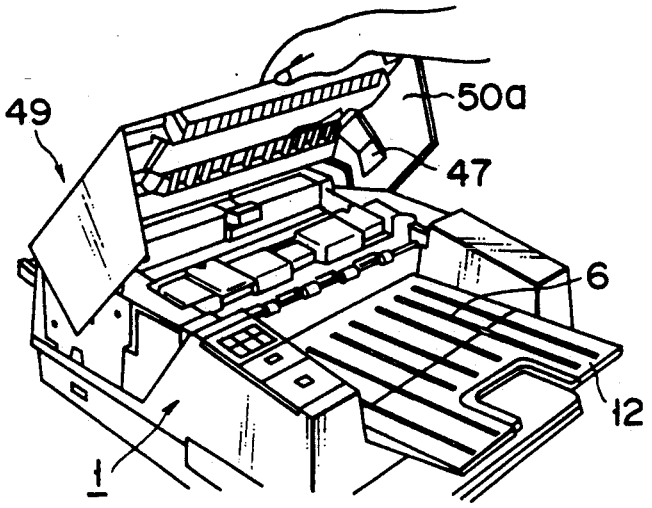

As is shown in FIG. 16, an operating projection 47 is provided on a right-hand inner surface 50a of the top cover 49. The operating projection 52 opens and closes a rotary shutter of a cartridge-type developing agent processing unit 60 for supplying toner to the developing unit 23 (described later), in interlock with the opening/-closing operation of the top cover 49.

Figure 17:
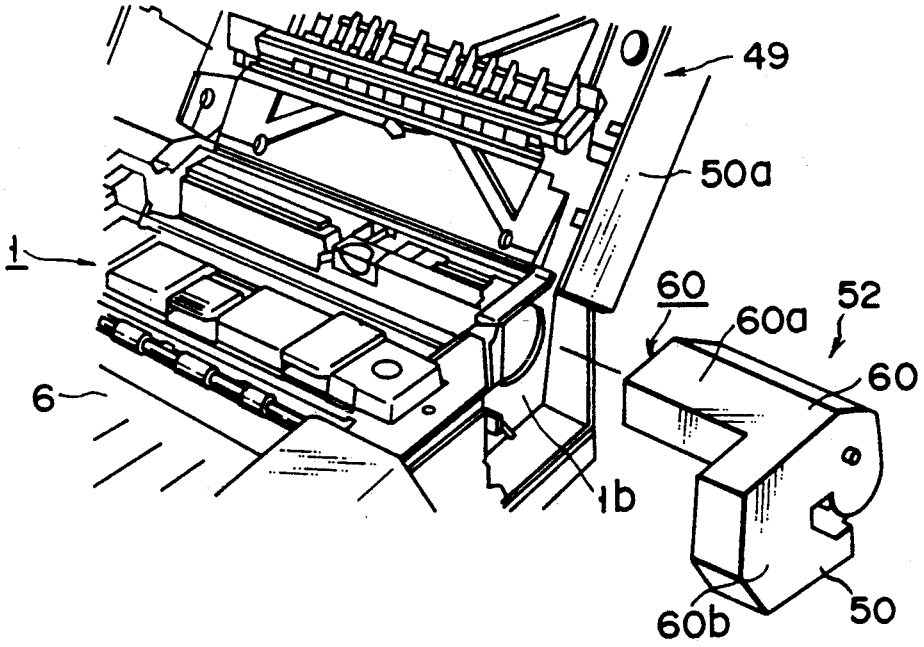

The unit 60 is removably inserted from the side of the right frame portion 1b of the body 1, as shown in FIG. 17, and is connected to a toner supply hole 23a at the upper part of the developing unit 23. At the same time, a toner discharge hole 23b of the developing unit 23 is connected to a waste toner receiving hole 60c of the unit 60.

The structure of the unit 60 will now be described in greater detail with reference to FIGS. 1 to 12.

The cartridge type developing agent processing unit 60 comprises a main body 52 which includes a substantially cylindrical first container 61, and a box-shaped second container 50 integral with the first container, as shown in FIGS. 1 to 6. The first and second containers 61 and 50 are made of a synthetic resin such as ABS resin. The first container 61 defines therein a toner storing portion 60a storing a supply toner, and the second container 60b defines therein a waste toner recovery portion 60b for storing the toner removed from the photoconductive body 20 by means of the cleaning blade 25. The main body 52 includes a partitioning wall 53. The supply toner storing portion 60a and the waste toner recovery portion 60b are completely partitioned by the partitioning wall 53 so that supply toner and waste toner are not mixed.

Figure 2:
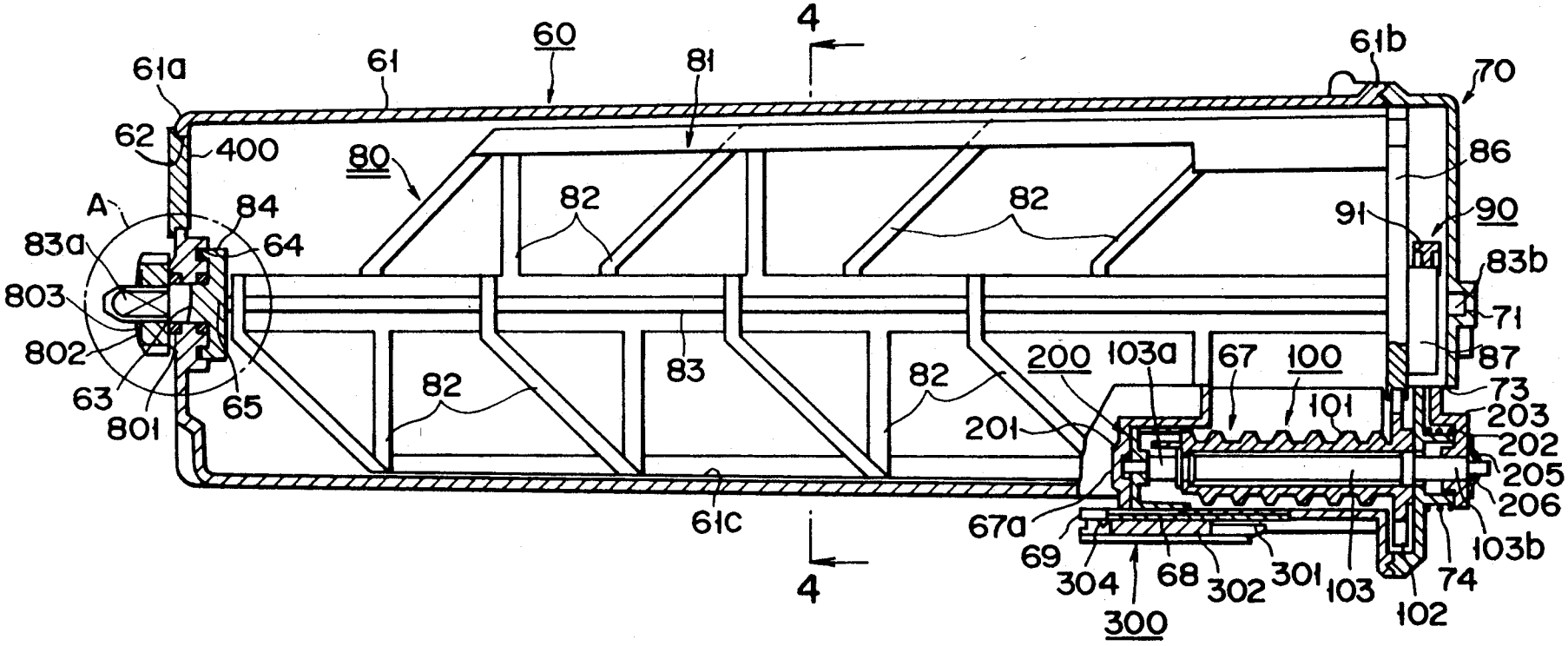
Figure 5:
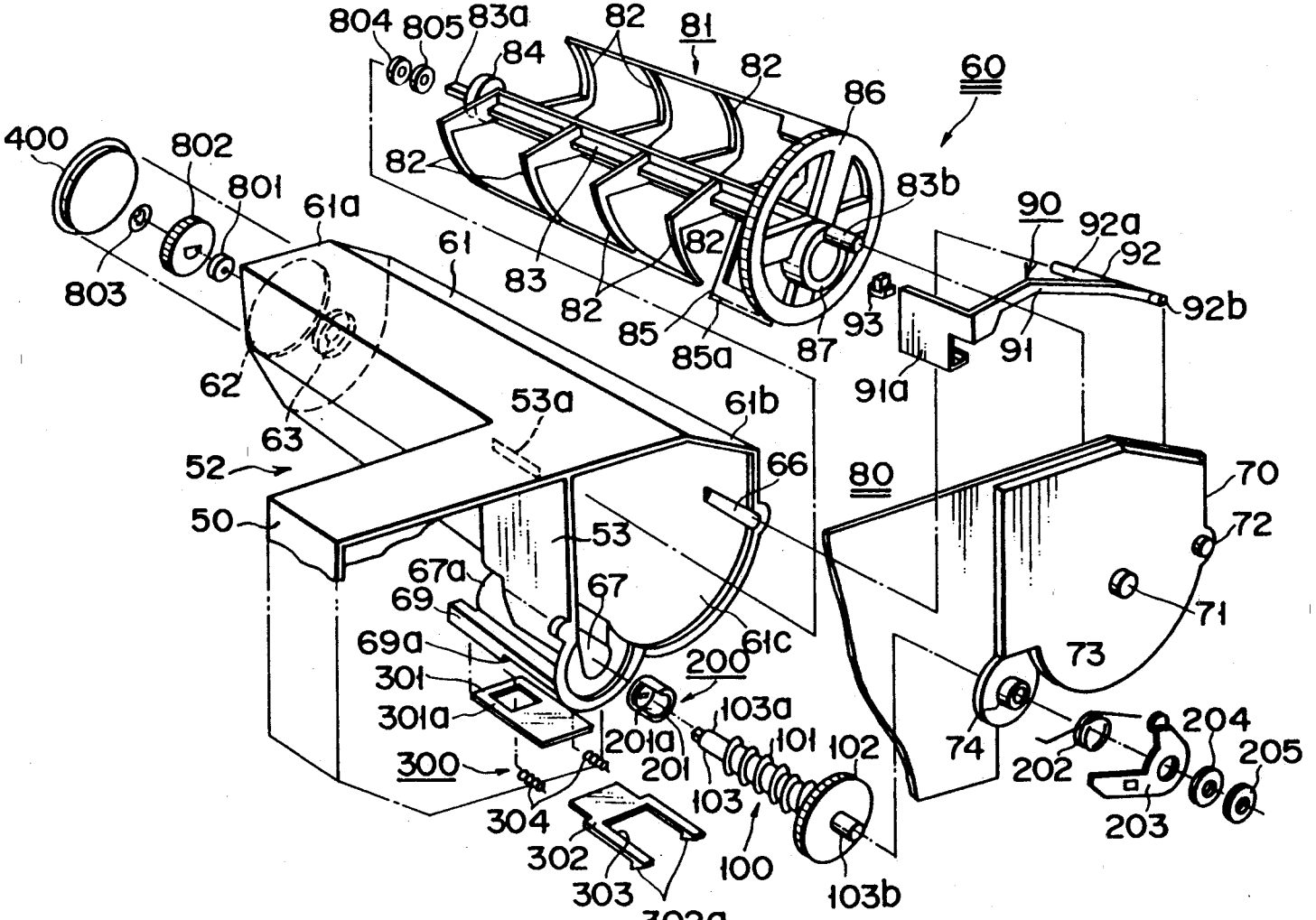

The first container 61 is formed in an elongated hopper, as shown in FIGS. 2 and 5. A left end 61a (in FIG. 2) of the container 61 along the longitudinal axis is closed and fitted in the apparatus body 1, and a right end 61b is opened. The container 61 is tapered, slightly widened from the left end 61a towards the right end 61b.

The left end 61a of the container 61 is provided with a toner filling port 62 and a shaft hole 63. A drive-side end portion 83a of a rotary shaft 83 of a puddle frame 82 of a toner agitator 81 which constitutes a toner supply mechanism 80 (described later) is inserted into the shaft hole 63. Double annular grooves 64 and 65 are formed in the left end 61a and located outside the shaft hole 63. The toner filling port 62 is closed by a cap 400 formed of a rubber, for example.

A bearing portion 66 is formed on the inner surface of right end portion of the container 61. An end portion 92a of a rotary shaft 92 of a magnet swing lever 91, which is a structural element of a waste toner agitator 90 (described later), is inserted into the bearing portion 66. The opened end 61b is tightly sealed by a cover 70b after the toner supply mechanism 80 has been assembled in the container 61. The inner surface of the cover 7 is provided with bearing portions 71 and 72. The bearing portion 71 supports the other end portion 83b of the rotary shaft 83 of the puddle frame 82 of the toner agitator 81, and the bearing portion 72 supports the other end portion 92b of the rotary shaft 92 of the waste toner agitator 90.

A toner supply portion 67 is formed in the right end of the bottom of the container 61. A toner convey mechanism 100 which constitutes the toner supply mechanism 80 is incorporated in the toner supply portion 67. A toner supply port 68 is formed in the left part, of the bottom of the toner supply portion 67. Toner that has fallen is supplied into the developing unit 23 through the toner supply port 68. First shutter mechanism 200 and second shutter mechanism 300 (described later) are arranged to face the toner supply port 68.

As shown in FIGS. 2 to 5, the toner agitator 81 is formed of ABS resin in a reel shape having a diameter of, e.g. 60 mm. Specifically, the agitator 81 has a rotary shaft 83 with a cruciform cross section, and a puddle frames 82 fixed to the shaft 83 and extending helically about the shaft. The drive-side end 83a of the rotary shaft 83 is inserted in the shaft hole 63 formed in the closed end 61a of the first container 61, and the other end 83b is inserted in the bearing portion 71 of the cover 70 which seals the opened end 61b of the container 61.

Figure 3:
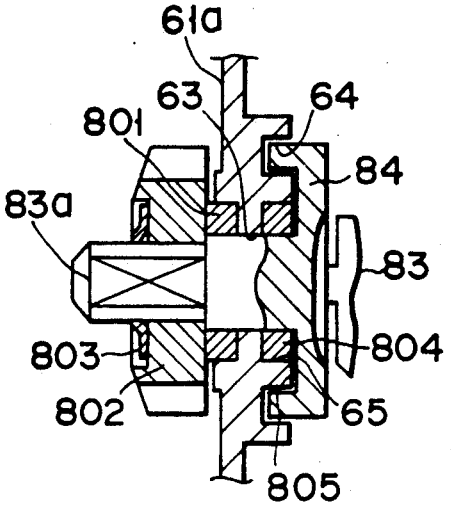
Figure 4:
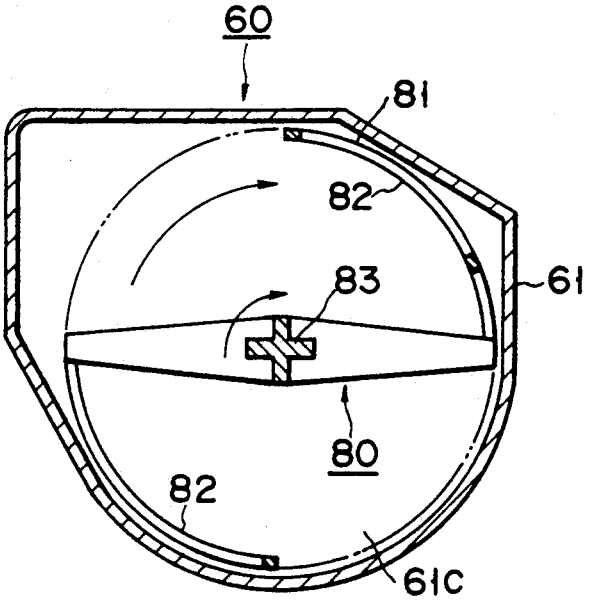

As is shown in FIG. 3, the drive-side end 83a projecting outside from the closed end 61a of the container 61 is coupled via a first pad 801 to a drive gear 802 capable of being meshed with another drive gear (not shown) on the apparatus body (1) side. The drive gear 802 is fixed by means of a spring washer 803. In addition, the drive-side end 83a of the rotary shaft 83 is integrated with an annular flange 84. The annular flange 84 is fitted in the outer annular groove 64 formed in the closed end 61a of the container 61. A second pad 804 is fitted in the inner annular groove 65.

A thin annular packing 805 is interposed between the second pad 804 and the inner surface of the annular flange 84, thereby constituting a shield structure. By virtue of a labyrinth effect, sealing and lubricating properties of the peripheral portion of the shaft 83 can be enhanced, and toner leakage, toner entrance to the peripheral portion of the shaft, generation of frictional heat and moisture entrance to the container 61 can be prevented.

Upon the operation of the toner agitator 81, toner stored in the container 61 is "double" stirred by the spiral rotation of the puddle frames 82 and the rotation of the rotary shaft 83 having the cruciform cross section, and the toner is conveyed from the left side in the container 61 to the toner supply portion 67 situated on the right end of the container 61. A toner raking plate 85 formed of an elastic thin material such as Mylar (tradename) or rubber is attached to an end portion 82a of one of the puddle frames 82 which opposes the toner supply portion 67. The distal end portion 85*a* of the toner raking plate 85 is slidable on the inner circumferential surface 61*c* of the first container 61. The toner, which has been conveyed to the right end portion of the container 61 by the rotation of the toner agitator 81, is raked and fed into the toner supply unit 67 by the toner rating plate 85.

A large-diameter gear 86 is integrated with the other end portion 83*b* of the rotary shaft 83 of the toner agitator 81. An eccentric cam 87 is integrated with the outside portion of the gear 86. The gear 86 is meshed with a small-diameter gear 102 integrated with a spiral shaft 101 which is a constituent element of the toner convey mechanism 100, thereby rotating the spiral shaft 101 in interlock with the rotation of the rotary shaft 83. The magnet swing lever 91 included in the waste toner agitator 90 is engaged with the eccentric cam 87 and vertically swung in accordance with the rotation of the large-diameter gear 86 and rotary shaft 83 of the toner agitator 81.

Figure 6:
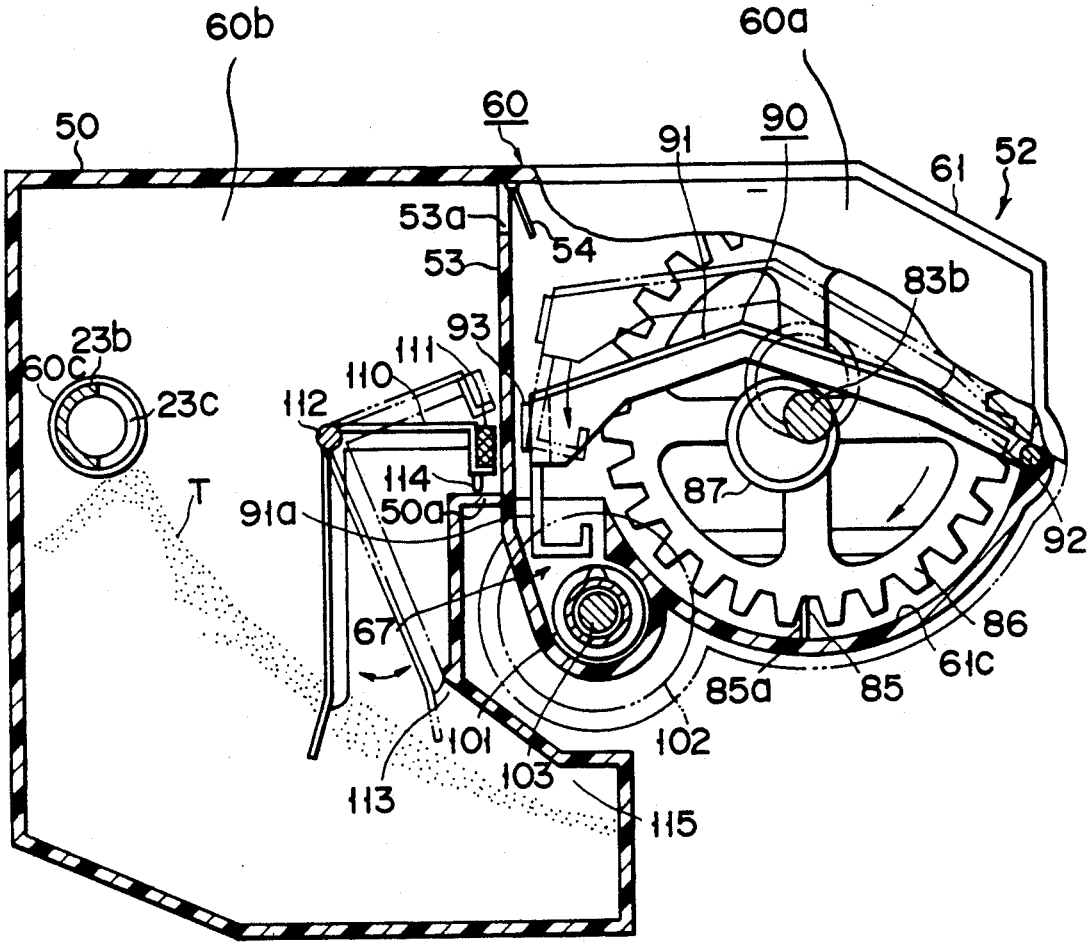

The magnet swing lever 91 has a substantially V-shape, as shown in FIGS. 5 and 6. On one end of the lever 91 is formed a rotary shaft 92 extending in parallel to the rotary shaft 83. One end 92*a* of the shaft 92 is inserted in the bearing 66 formed on the inner circumferential surface of the container 61, and the other end 92*b* of the shaft 92 is supported by the bearing 72 formed on the inner surface of the cover 70. A center portion of the lever 91 is mounted on the eccentric cam 87. A permanent magnet 93 is fixed to a swing end 91*a* of the lever 91. Thus, when the lever 91 is swung in accordance with the rotation of the eccentric cam 87, the permanent magnet 93 is moved substantially vertically along the partitioning wall 53. A waste toner stirring lever 110 of the waste toner agitator 90 is driven by the vertical movement of the magnet 93.

The toner convey mechanism 100 arranged in the toner supply portion 67 will be described.

As shown in FIGS. 2, 5 and 6, the toner convey mechanism 100 includes a hollow spiral shaft 101 and a small-diameter gear 102. The shaft 101 has at least two threads and has a diameter of, for example, 12 Mm. The gear 102 is integrated with that end of the shaft 101 which is close to the cover. A support shaft 103 is loosely inserted into the spiral shaft 101 so as to allow the rotation of the shaft 101. One end portion 103*a* of the support shaft 103 is journalled at the closed end face 67*a* of the toner supply portion 67. The other end portion 103*b* of the shaft 103 is journalled in a shaft hole 74 formed at a stepped recess 73 of the cover 70. Thus, the shaft 103 extends in parallel to the rotary shaft 83 of the toner agitator 81.

The small-diameter gear 102 integrated with the spiral shaft 101 is meshed with the large-diameter gear 86 formed integrally with the end portion 83*b* of the rotary shaft 83. When the gear 86 is rotated, the spiral shaft 101 is rotated accordingly, and the toner supplied into the toner supply portion 67 is conveyed from the right to the left-side toner supply port 68. In this case, if spiral shafts 101 having various threads are suitably used, the toner supply amount can be controlled finely, without changing the number of rotations of the spiral shaft 101.

As shown in FIGS. 2, and 5 to 7, the first shutter mechanism 200 is arranged above the toner supply port 68 opening at the left-side bottom portion of the toner supply portion 67. The first shutter mechanism 200 has a rotary shutter 201 attached to an end 103*a* of the support shaft 103 which is inserted loosely into the spiral shaft 101, and is rotatable integral with the shaft 103. The shutter 201 is provided with a notch 201*a* for passing the toner. A return spring 202 is fitted to the end 103*b* of the support shaft 103, which projects outside through the shaft hole 74 formed in the cover 70. The return spring 202 urges the support shaft 103 in a direction so that the notch 201*a* of the shutter 201 is away from a position wherein the notch faces the toner supply port 68. To the other end 103*b* of the support shaft 103 is attached an operating lever 203 for rotating the support shaft 103 against the urging force of the return spring 202 in such a direction that the notch 201*a* of the rotary shutter 201 is brought to the position corresponding to the toner supply port 68. The operating lever 203 is fixed to the other end 103*b* of the support shaft 103 via a pad 204 and a spring washer 205.

Figure 7:
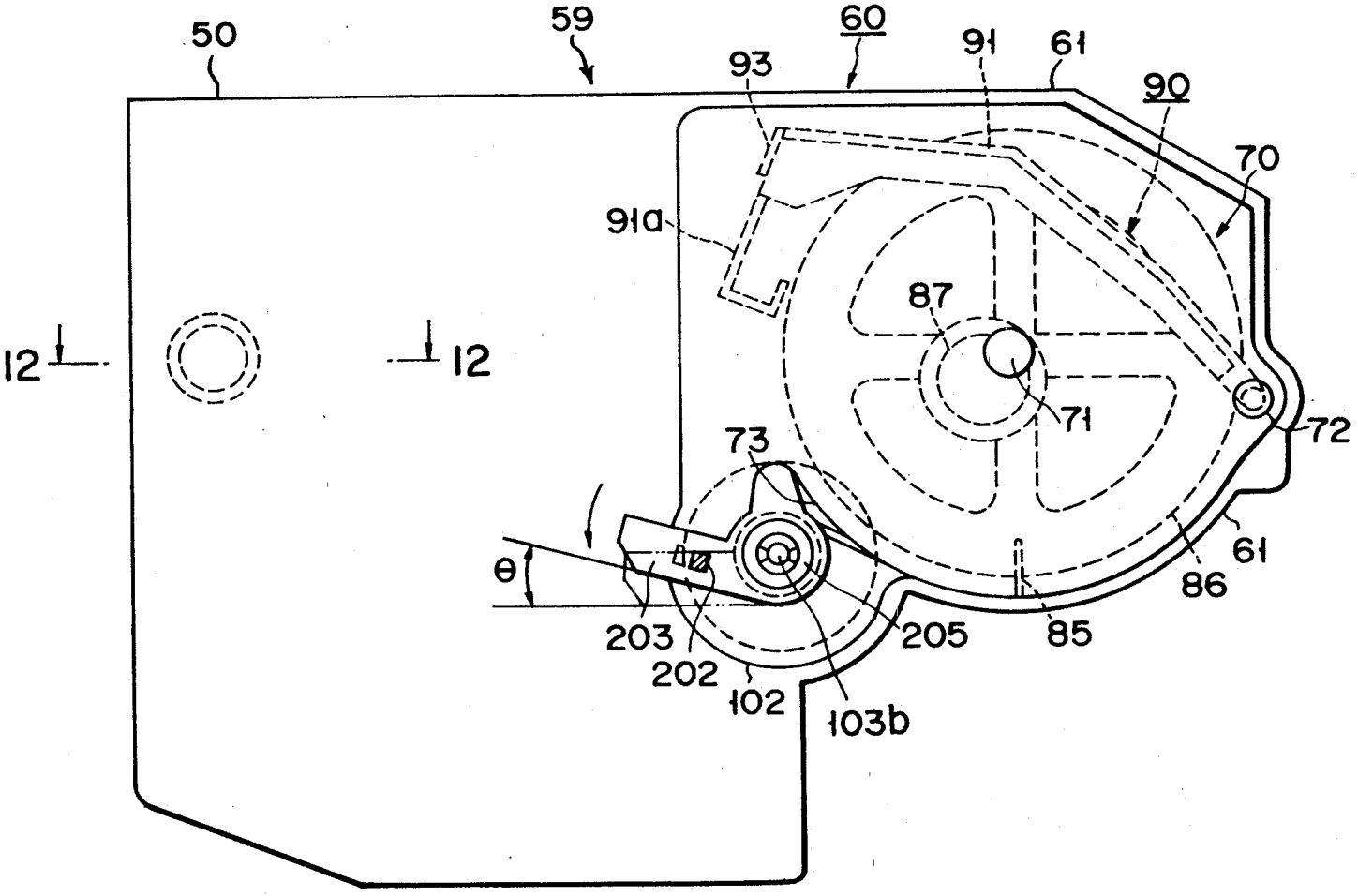
Figure 8:
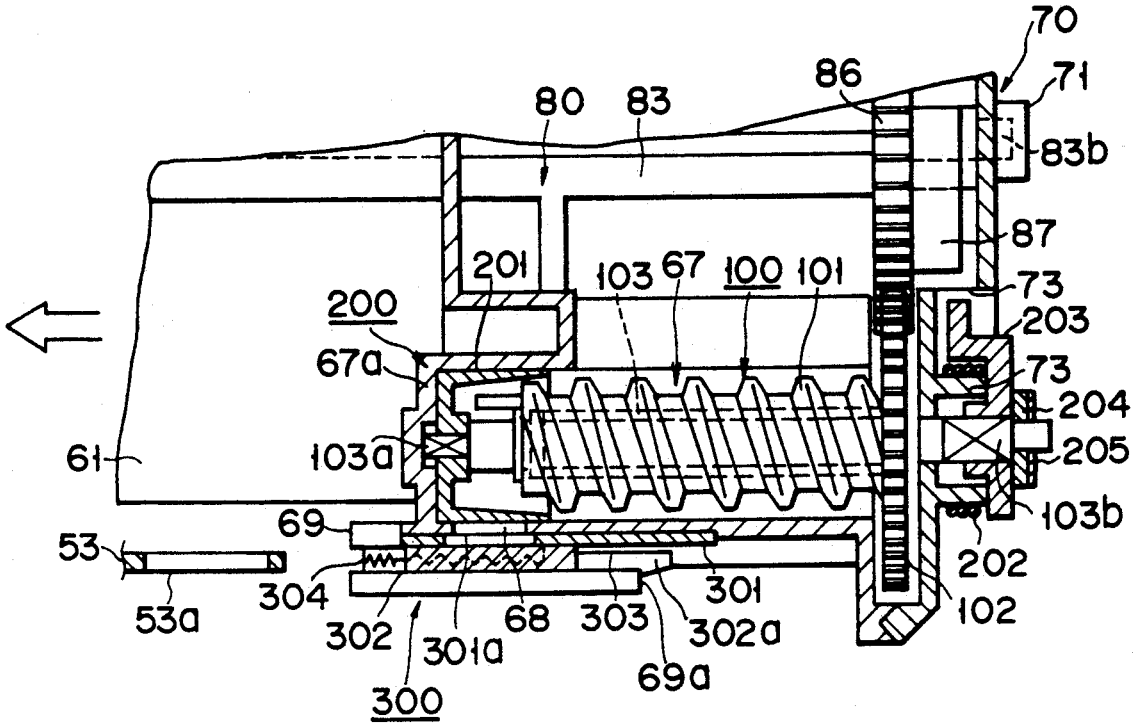
Figure 9:
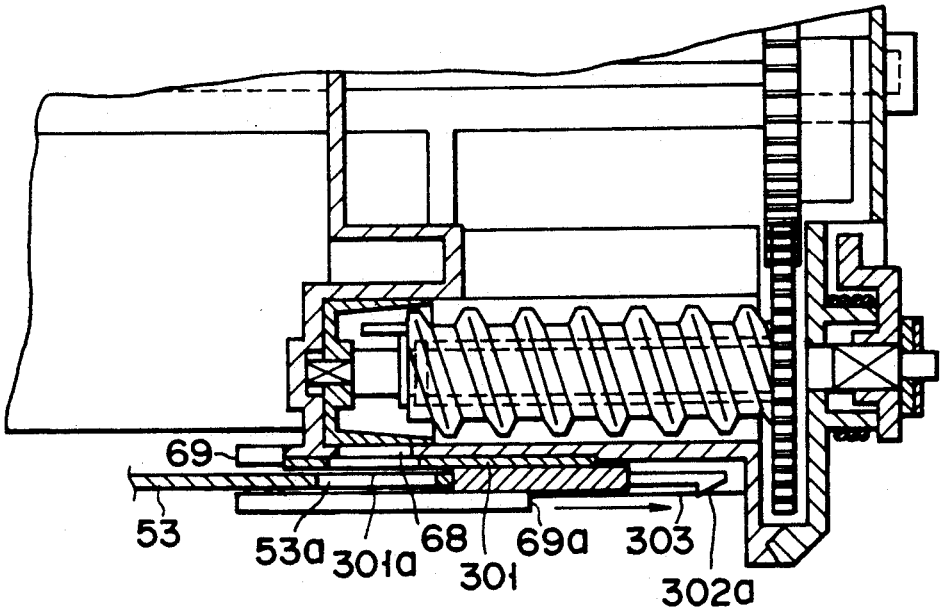

The operating lever 203 is released from the pressing operation by means of an operating projection 47 provided on the inner face 50*a* of the top cover 49, as shown in FIGS. 7, 8 and 9, when the toner processing unit 60 is not mounted in the apparatus body 1, or when the unit 60 is mounted in the apparatus body 1 and the top cover 49 of the apparatus body 1 is in the opened position as shown in FIGS. 15 and 16. Thus, the toner supply port 68 is closed by the rotary shutter 201.

Figure 10:
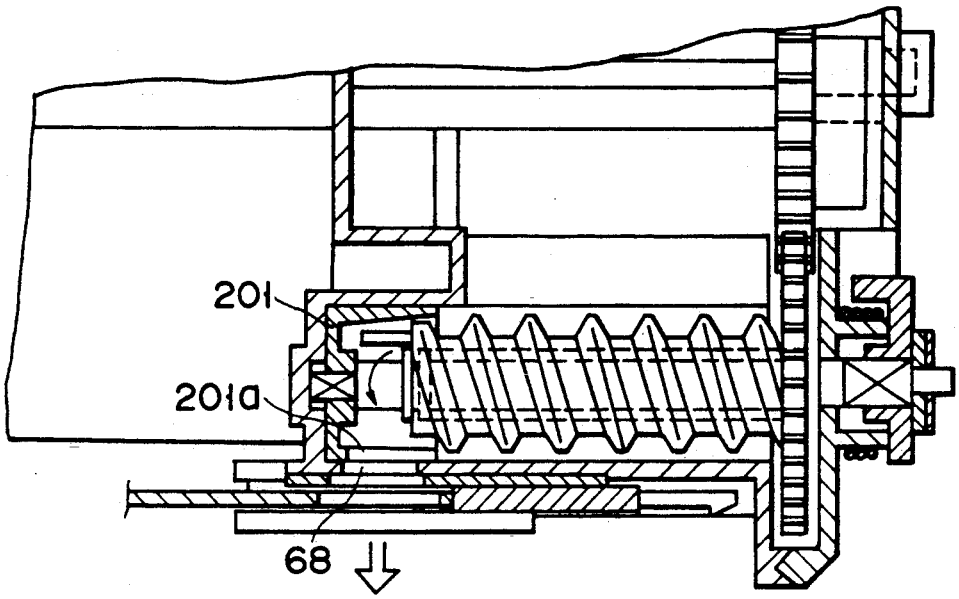

When the toner processing unit 60 is mounted in the apparatus body 1 and the top cover 49 is in the closed position, as shown in FIGS. 13 and 14, the operating lever 203 is pressed by the operating projection 47 of the top cover 49 in the direction indicated by a solid arrow in FIG. 7, and rotated by an angle $\theta$ (about 12°), as indicated by a two-dot-and-dash line in FIG. 7, against the urging force of the return spring 202. In accordance with this rotation, the support shaft 103 is synchronously rotated in such a direction that the notch 201*a* of the rotary shutter 201 is brought to the position corresponding to the toner supply port 68. Thus, the upper part of the toner supply port 68 is opened, as shown in FIG. 10. The second shutter mechanism 300 is arranged below the toner supply port 68. As shown in FIGS. 2, 5 and 8 to 10, the second shutter mechanism 300 comprises a slide shutter 302, an opened portion 303 formed in one end of the shutter 302, and compression springs 304 for urging the shutter in a direction. The slide shutter 302 is slidably fitted between slide grooves 69 formed in the bottom of the toner supply portion 67. A pad 301 having a notch 301*a* is arranged between the shutter 302 and the toner supply port 68. The compression springs 304 urge the slide shutter 302 in a direction so as to prevent the opened portion 303 from being brought to the position corresponding to the toner supply port 68.

The slide shutter 302 has engagement claws 302*a* at one end thereof on the opened portion (303) side. The claws 302*a* are engageable with engagement stepped portions 69*a* of the slide grooves 69. Thereby, removal of the slide shutter 302 is prevented when the toner supply port 68 is closed by the slide shutter 302. As is shown in FIG. 17, the second shutter mechanism 300 is actuated only when the unit 60 is mounted in the apparatus body 1 or when it is removed for exchange.

For example, when the toner processing unit 60 is mounted in the apparatus body 1, as shown in FIG. 8, a butt plate 53, which has a supply port 53*a* facing a toner supply port 23*a* (see FIG. 1) of the developing unit 23 in the apparatus body 1, is inserted into the slide grooves 69. The butt plate 53 pushes the slide shutter 302 against the urging force of the compression springs 304 in an opening direction indicated by a solid arrow in FIG. 9. Thus, the opened portion 303 of the slide shutter 302 is made to correspond to the toner supply port 68, and the lower part of the toner supply port 68 is opened, as shown in FIG. 10. In this case, when the top cover 50 of the apparatus body 1 is in the opened state, the first shutter mechanism 200 is not opened, as shown in FIG. 9, even if the lower part of the toner supply port 68 is opened by the second shutter mechanism 300.

Even if the operating lever 203 of the first shutter mechanism 200 is erroneously rotated while the processing unit is not mounted in the apparatus body 1, the second shutter mechanism 300 continues to close the toner supply port 68. Thereby, leakage of toner from the toner supply port 68 is prevented during the transfer of the unit 60 and the mounting operation of the unit, unless the unit 60 is completely mounted in the apparatus body 1 and at the same time the top cover 49 of the apparatus body 1 is closed.

The structure of the waste toner recovery portion 60*b* of the toner processing unit 60 will now be described.

As shown in FIGS. 5 to 7 and 11, the second container 50 defining the reconvey portion 60*b* is integral with the first container 61. The opening end of the second container 50 is closed by the cover 70 which is welded to the second container. A waste toner receiving hole 60*c* is formed in the front wall of the container 50, which faces the developing unit 23. A cap 121 is arranged in the container 50 to face the receiving hole 60*c*. The cap 121 is urged by the a compression spring 122 provided between the cap and the cover 70 and closes the receiving hole 60*c*.

The developing unit 23 has a toner discharge portion 23*b* (see FIG. 1) which designed to be inserted into the receiving hole 60*c* of the second container 50. The toner discharge portion 23*b* is formed in the form of a cylinder having a distal end closed by an end plate 23*f*. An opening 23*c* for discharging toner is formed in the peripheral wall of the toner discharge portion 23*b*. The opening 23*c* looks to the side, i.e. to the right. The rotary shaft of the convey spiral 42 for conveying waste toner scraped by the cleaning blade 25 (see FIG. 14) extends through the discharge portion 23*b* and is journalled on the end plate 23*f*. A cylindrical slide shutter 23*d* is slidably mounted on the outer circumference of the toner discharge portion 23*b*. The slide shutter 23*d* is urged towards the end plate 23*f* by a compression spring 23*e* provided around the discharge portion 23*b*, thereby closing the opening 23*c*.

Figure 1:
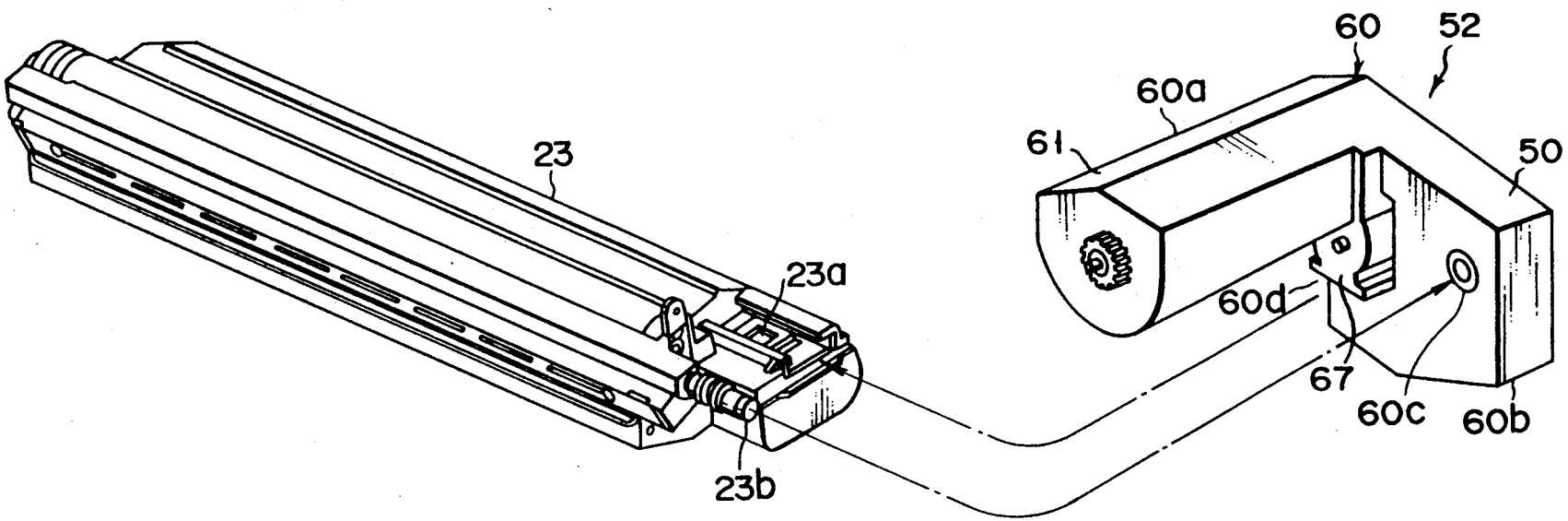
Figure 12:
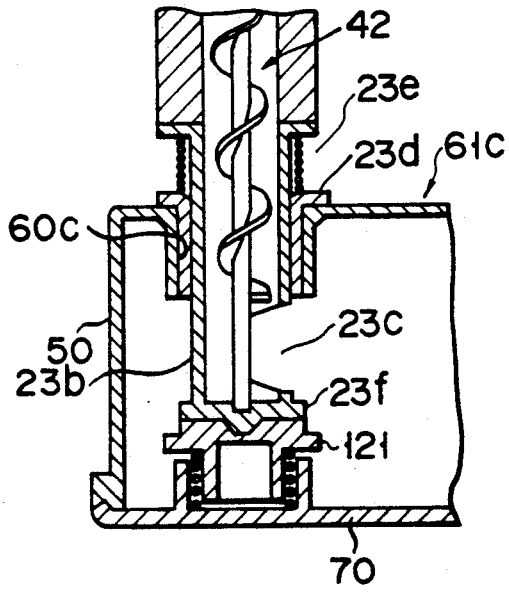

When the processing unit 60 is set in the apparatus body 1, the toner discharge portion 23*b* of the developing unit 23 pre-mounted in the apparatus body 1, as shown in FIG. 1, is inserted in the waste toner receiving hole 60*c* of the processing unit 60. Then, the cap 121 situated in the recovery portion 60*b* is pressed by the end plate 23*f* of the toner discharge portion 23*b* and is moved to the vicinity of the cover 70 against the urging force of the compression spring 122. In addition, the slide shutter 23*d* is put in the waste toner receiving hole 60*c*, and its flange portion is stopped in the state wherein the flange portion is abut against the front wall of the container 50 by the compression spring 23*e*. And only the end portion of the discharge portion 23*b* is further inserted into the container 50. Thereby, as shown in FIGS. 6 and 12, the opening 23*c* of the toner discharge portion 23*b* is open in the waste toner recovery portion 60*b*. In the embodiment, the opening 23*c* is open to the right, that is, to the partition plate 53 of the processing unit 60.

In this state, the slide shutter 23*d* closes the gap between the waste toner receiving hole 60*c* and the toner discharge portion 23*b* and prevents leakage of recovery toner in the container 50. In addition, the opening 23*c* is completely opened in the recovery portion 60*b*, and the waste toner conveyed from the convey spiral 42 is smoothly discharged through the opening 23*c* and stored in the recovery portion 60*b*, as shown in FIG. 6.

When the processing unit 60 is removed from the apparatus body 1, the opening 23*c* of the toner discharge portion 23*b* of the developing unit 23 and the waste toner receiving hole 60*c* of the second container 50 are brought to the state of FIG. 11 once again and are closed by the slide shutter 23*d* and cap 121, respectively. Thus, leakage of toner is prevented.

As described above, the waste toner receiving hole 60*c* of the processing unit 60 and the toner supply port 68 shown in FIG. 2 are always closed when the processing unit 60 is attached, removed and carried, thereby preventing toner leakage. In addition, since the shutter mechanisms for opening and closing the waste toner receiving hole 60*c* and toner supply port 68 are operated in the same direction, the processing unit 60 can be mounted on the apparatus body 1 only by inserting the processing unit 60 in the body 1 from the side of the right frame portion 1*b* of the body 1, whereby toner can be supplied to the developing unit 23 and waste toner recovered from the developing unit 23.

Since the toner supply hole 23*a* of the developing unit 23 and the toner discharge hole 23*b* are situated on one side of the developing unit 23, as shown in FIG. 1, two different functions of toner supply and toner recovery can be integrated in the processing unit 60 with a very simple shape. In addition, the processing unit 60 can be mounted by effectively utilizing a small space of the right frame portion 1*b* of the apparatus body 1 shown in FIG. 14, and waste toner can be stored.

When the toner supply port 68 and waste toner receiving hole 60*c* of the toner processing unit 60 are fitted to the toner supply hole 23*a* and toner discharge portion 23*b* of the developing unit 23, respectively, as shown in FIG. 1, the following problem occurs.

Although the distance between the toner supply portion 67 and the waste toner receiving hole 60*c* of the unit 60 is designed to be equal to that between the toner supply hole 23*a* and the toner discharge portion 23*b* of the developing unit 23, a slight error in these distances is inevitable. Consequently, if these insertion portions are formed with no clearance, the toner processing unit 60 is not smoothly engaged the developing unit 23. Therefore, it is necessary to provide suitable clearance on either side of these insertion portions.

Figure 11:
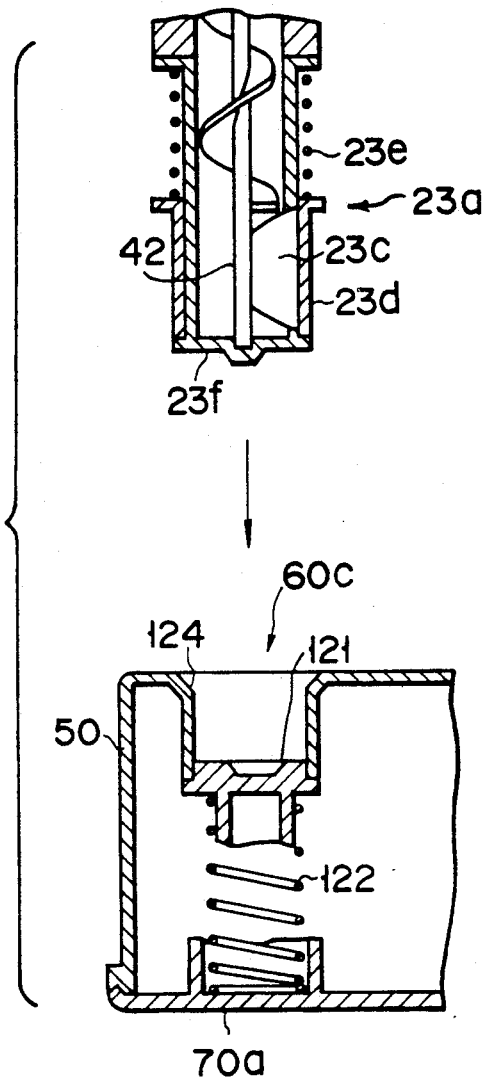

In this embodiment, a clearance is defined between the toner supply hole 23*a* and the toner supply portion 68. However, in this state, the alignment between the toner discharge hole 23*b* and the waste toner receiving hole 60*c* is difficult. Thus, in this embodiment, as shown in FIG. 11, a chamfered portion is provided at the end edge of the waste toner receiving hole 60*c*. Thereby, the processing unit 60 can be mounted very smoothly.

As shown in FIG. 6, in the toner reconvey portion 60*b* is arranged the waste toner stirring lever 110 serving as the recovery toner agitator 90 for agitating the recovered waste toner. The stirring lever 110 is adapted to be driven by the magnet swing lever 91 arranged in the storing portion 60*a* of the first container 61. Specifically, the waste toner stirring lever 110 has an L-shape. On the corner portion of the lever 110 is provided a rotary shaft 112 extending in parallel to the rotary shaft of the toner agitator 81. Both end portions of the rotary shaft 112 are inserted in and supported by bearings (not shown) formed on the right side wall of the second container 50 and the cover 70, respectively. A right end of the arm portion of the lever 110 is located close to the partitioning wall 53, and a magnetic member (iron) 111 is fixed to the right end. A lower end portion of that arm portion of the lever 110 which extends downward is formed like a knife, so that toner can easily be stirred.

Normally, the lever 110 is urged to rotate clockwise about the rotary shaft 112 owing to the weight of the magnetic body 111 attached to the right end of the lever 110. However, a projection 114 attached below the magnetic body 111 abuts on a stepped portion 50*a* of the second container 50, and the lever 110 remains static in the position shown by a solid line in FIG. 6. If the permanent magnet 93 moves upwards in this state, the magnetic body 111 situated near the magnet with the partitioning wall 53 interposed is lifted by the magnetic attraction force of the magnet 110 . Accordingly, the waste toner stirring lever 110 rotates counterclockwise about the shaft 112, and the lower end portion of the lever 110 abuts on a projection 113 provided on the inner surface of the container 50 so that the lever 110 is stopped, as indicated by the two dot and dash line in FIG. 6.

The magnet 93, however, further moves upwards, and the distance between the magnet 93 and the magnetic body 111 increases. At last, the magnetic attraction force of the magnet 93 acting on the magnetic body 111 decreases to a level lower than the weight of the magnetic body 111. Thus, the lever 110 rotates clockwise and returns to the original position. By this swing motion of the stirring lever 110, the knife-shaped lower end portion of the lever 110 moves right and left to agitate the recovered toner T in the recovery portion 60*b*, thereby flattening the toner T.

The reasons for the necessity of the above recovery toner agitator 90 will now be stated.

The toner discharge portion 23*b* of the developing unit 23 shown in FIG. 1 is inserted into the waste toner receiving hole 60*c* of the waste toner recovery portion 60*b* of the second container 50. Thus, the opening 23*c* of the toner discharge portion 23*b* is completely located in the recovery portion 60*b*. In this state, the storage of recovery toner is made possible. However, if toner is recovered in this state, the recovered toner T is accumulated like a mountain, as shown in FIG. 6. The top of the accumulated toner closes the opening 23*c* of the toner discharge portion 23*b*. Considering this, in this embodiment, the opening 23*c* is provided to open laterally.

In most cases, such an opening is provided to face downwards. If the opening 23*c* faces downwards, the toner can be smoothly fallen and discharged in the initial stage. However, as the amount of toner in the recovery portion 60*b* increases, the top of the accumulated toner closes the opening 23*c* and prevents the discharge of the toner from the opening. Finally, the toner clogs the toner discharge portion 23*b* and the cleaning mechanism on the upstream side of the discharge portion 23*b*, thereby locking the toner convey spiral 42.

In order to solve the above problem, by providing the opening 23*c* laterally (the right side in this embodiment), as shown in FIG. 6, the toner can be smoothly discharged unless the toner discharge portion 23*b* is completely covered with recovery toner T. The reason why the opening 23*c* is provided on the right side is that the top of the accumulated toner T can be brought to the center portion in the recovery portion 60*b* as close as possible and the storage limit mount of recovery toner T, which closes the opening 23*c*, can be increased.

On the contrary, if the opening 23*c* is provide on the left side, the above advantages can hardly be obtained, and the toner filling efficiency in the recovery portion 60*b* is degraded as in the case where the opening is provided to face downwards. This is clear from experiments.

However, even if the above means is adopted, the recovered toner T is accumulated in a mountain-shape and a difference in height between the top and the base portion of the accumulated toner T is large. The toner filling efficiency is not good at the time when the opening 23*c* is closed by toner T. In particular, a cavity appears at the lower right portion 115 in the recovery portion 60*b*, so that the toner filling efficiency is lowered.

Under the above circumstances, by causing the knife-shaped lower end portion of the waste toner stirring lever 110 to swing laterally, the toner T can be brought to the lower right portion 115 in the recovery portion 60*b* and the difference in height between the top and base portions of the accumulated toner T can be reduced. Thus, the toner filling efficiency of the recovery portion 60*b* at the time when the opening 23*c* is closed can remarkably be improved.

As has been described above, the waste toner stirring lever 110 is driven through the partitioning wall 53 by the magnetic attraction force of the permanent magnet 93 attached to the magnet swing lever 91 in the first container 61. It is advantageous that there is no need to provide a power source in the second container 50.

Even with this waste toner stirring mechanism, however, the opening 23*c* is covered with recovery toner T if the recovery of toner T is continued. Conventionally, it has been considered that the discharge of toner is not possible in this state. In fact, if the opening 23*c* faces downwards, the toner discharge portion 23*b* is clogged by toner shortly. However, if the opening 23*c* is provided laterally, as in this embodiment, the toner can be discharged from the opening 23*c* even if the opening 23*c* is covered with the toner, although smoothness of discharge is somewhat degraded.

Specifically, if toner T is discharged into the recovery portion 60*b*, against the resistance of the accumulated toner T, the resistance in the downward direction is very high whereas the resistance in the lateral and upward directions is low. It is therefore possible to fill that space in the recovery portion 60*b* which is defined above the opening 23*c* with toner T. It was found from experiments that, according to this embodiment, the inner space of the recovery portion 60*b* was substantially filled with the recovered toner T. Thus, the space above the opening 23*c*, which has conventionally been considered to be needless, can be used for storing the recovered toner, though not completely.

As stated above, even if the filling ratio of recovery toner is increased by some technique, it is possible that the toner recovery amount increases abnormally for some reason and the waste toner recovery portion 60*b* is filled completely. In this case, the following waste toner can not be discharged into the recovery portion 60*b*, thereby locking the toner convey mechanism. To solve this problem, a through-hole 53*a* is formed in an upper end portion of the partitioning wall 53 which separates the storing portion 60*a* and the recovery portion 60*b*. When the recovery portion 60*b* is filled with the recovered toner T, excess toner T is fed to the supply portion 60*a* through the through-hole 53*a*.

Thus, even when the amount of waste toner increases abnormally and exceeds the capacity of the recovery portion 60*b*, the excess toner does not clog the toner discharge portion 23*b* or lock the convey spiral 42. Accordingly, waste toner can be recovered in the recovery portion 60*b* smoothly and continuously. The amount of excess toner fed to the supply portion 60*a* is relatively small, and does not considerably influence the quality of images to be formed.

A flapper valve 54 for opening and closing the through-hole 53*a* is provided within the body 52 of the processing unit 60. The flapper valve 54 is pivotally attached to on the inner surface of the top wall of the body 52. The flapper valve 54 is urged toward the waste toner recovery portion 60*b* by means of a spring, etc. (not shown) and brought into contact with the partitioning wall 53. Thus, the flapper valve 54 allows only movement of toner which flows from the recovery portion 60*b* into the storing portion 60*a* through the through-hole 53*a*, and the valve 54 prevents reverse flow of toner from the storing portion 60*a* to the recovery portion 60*b*. Accordingly, new toner does not enter the waste toner recovery portion 60*b*.

As has been described above, according to the present embodiment, the two functions of toner supply and toner recovery are integrated in the developing agent processing unit 60, and the following advantages can be obtained.

Conventionally, a toner supply container and a toner recovery container are provided separately. An apparatus body is generally provided with a detector switch for detecting the presence of each container. That is, two detector switches must be provided. By contrast, according to the present embodiment, since two containers are integrated, only one switch is required to detect the presence of the containers, so that the manufacturing cost of the apparatus body 1 can be lowered.

In addition, according to the present embodiment, a switch for detecting the full state of the waste toner recovery portion 60*b* can be dispensed with. Conventional apparatus body has a detection function for detecting the full state of the waste toner recovery portion. When the full state of the recovery portion is detected, the apparatus body informs the operator of the full state by means of voice, display, etc. Thus, the operator can replace the toner recovery unit with a new one.

In the present embodiment, however, the apparatus body 1 detects only the presence/absence of toner in the toner supply portion 60*a*, and when the supply toner is "empty", the operator replaces the toner processing unit 60 with a new one. In other words, the state of the toner in the recovery potion 60*b* is not detected. As a matter of course, even when the recovery portion 60*b* is filled with recovered toner, the apparatus body 1 continues the printing operation.

Thus, in the present embodiment, the ratio of the capacity of the toner storing portion 60*a* to that of the waste toner recovery portion 60*b* in the processing unit 60 is determined as follows:

supply toner storage capacity > waste toner storage capacity > (amount of toner supplied to the developing unit) X (untransferred percentage of toner).

For the purpose of safety, it is desirable that the waste toner storage capacity be as large as possible. If this capacity is substantially equal to the supply toner storage capacity, the waste toner recovery portion 60*b* cannot become "full" in case of any trouble. However, the inner space of the apparatus body 1 is limited, and the waste toner storage capacity is naturally limited to a minimum capacity required. The minimum capacity required is represented by (amount of toner supplied to the developing unit) X (untransferred percentage of toner). More specifically, the capacity for storing the amount of toner that has not been transferred on paper P, after all toner in the supply toner storing portion 60*a* has been consumed, must be provided as a minimum capacity required.

Normally, the transfer efficiency of toner is 75% to 90%, and 10% to 25% of supplied toner is recovered as untransferred toner. Therefore, 25% of the supplied toner must be stored in the waste toner recovery portion 60*b*. In fact, however, it is required that the effective capacity of the recovery portion 60*b* is set to be 30% of the capacity of the storing portion 60*a*, taking into account the troubles of charging, transfer, bias voltage, etc. Thus, in the present embodiment, the capacity of the storing portion 60*a* is 500 cc whereas that of the recovery portion 60*b* is 150 cc.

Accordingly, even if the function of detecting the waste toner "full" state in the apparatus body 1 is omitted, the printing operation can be continued with no problem, and the cost of the apparatus body can be reduced. In addition, the operation is free from the troublesome procedure of exchanging the waste toner container 50.

Even when it is required that the capacity of the toner recovery portion is set equal to or less than the minimum capacity required (amount of toner supplied to the developing unit) X (untransferred percentage of toner), the excess toner T can be fed to the toner storing portion 60*a* through the through-hole 53*a* and the flapper valve 54. Thus, no trouble is generated.

As has been described above, the toner supply container for storing toner and the waste toner container for storing the waste toner are integrated into a toner processing unit. Thus, these containers can be exchanged with new ones by a single process and the operability of the apparatus can be enhanced.

Furthermore, the processing unit is detachable from the cleaning device and developing unit, therefore, the unit can be exchanged singly, there is no need to exchange the cleaning device and developing unit unnecessarily, and the running cost of the apparatus can be reduced.

Even when the amount of the waste toner exceeds the capacity of the recovery portion, the excess toner is fed into the toner storing portion of the first container. Thus, the apparatus body can be prevented from being stained with the waste toner.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

means for supplying an image carrier with a developing agent to form a developed image;

means for transferring the developed image onto a recording medium;

means for removing the developing agent remaining on the image carrier after the image transfer by the transferring means;

means for storing the developing agent which is to be supplied to the image carrier by the supplying means;

means, having a predetermined capacity, for receiving the developing agent removed by the removing means;

means for introducing the developing agent in the receiving means into the storing means only when the amount of developing agent in the receiving means approaches the capacity of the receiving means; and means for integrally supporting the storing means, the receiving means and the introducing means, the supporting means being detachably fitted to the supplying means and the removing means;

the supporting means including a body having the storing means and the receiving means, and partitioning means for partitioning the storing means and the receiving means from each other, the introducing means including a through-hole formed in the partitioning means and making the receiving means communicate with the storing means, and valve means provided at the partitioning means, for restricting movement of the developing agent from the storing means to the receiving means through the through-hole and allowing movement of the developing agent from the receiving means to the storing means through the through-hole.

2. An image forming apparatus comprising:

means for developing a latent image formed on an image carrier, by using a developing agent;

means for transferring the developed image onto a recording medium;

means for removing the developing agent remaining on the image carrier after the image transfer by the transferring means; and a developing agent processing unit detachably fitted to the developing means and the removing means, said processing unit including:

a first container having a storing portion storing the developing agent;

means arranged in the first container, for supplying the developing agent in the storing portion to the developing means;

a second container formed as one body with the first container, and including a recovery portion for receiving the developing agent removed by the removing means;

means for stirring the developing agent received in the recovery portion;

a partition portion arranged at a boundary between the first container and the second container, for partitioning the storing portion and the recovery portion from each other;

a communication portion having a through-hole formed in the partition portion, for introducing, only when the amount of the developing agent received into the recovery portion approaches a capacity of the recovery portion, part of the developing agent into the storing portion; and valve means provided on the partition portion, for restricting movement of the developing agent from the storing portion to the recovery portion through the through-hole and allowing movement of the developing agent from the recovery portion to the storing portion through the through-hole.

3. An image forming apparatus comprising:

means for supplying an image carrier with a developing agent to form a developed image;

means for transferring the developed image onto a recording medium;

means for removing the developing agent remaining on the image carrier after the image transfer by the transferring means;

a first storage unit for storing the developing agent which is to be supplied to the image carrier by the supplying means;

a second storage unit for receiving the developing agent removed by the removing means, the second storage unit being separated from the first storage unit by a partition; and means for introducing the developing agent in the second storage unit into the first storage unit only when the amount of developing agent in the second storage unit approaches the capacity of the second storage unit, the introducing means including a valve device through said partition and connecting the first and second storage units.

4. An apparatus according to claim 3, wherein said first and said second storage units are integrally formed and detachably connected as a single unit from said supplying means, said removing means and said transferring means.

5. An image forming apparatus comprising:

means for supplying an image carrier with a developing agent to form a developed image;

means for transferring the developed image onto a recording medium;

means for removing the developing agent remaining on the image carrier after the image transfer by the transferring means;

means for storing the developing agent which is to be supplied to the image carrier by the supplying means;

means for receiving the developing agent removed by the removing means, the receiving means having a capacity which is less than or equal to 25% of the capacity of the storing means;

means for introducing the developing agent in the receiving means into the storing means, only when the amount of developing agent in the receiving means approaches the capacity of the receiving means; and means for integrally supporting the storing means, the receiving means and the introducing means, and the supporting means being detachably fitted to the supplying means and the removing means.

6. An image forming apparatus comprising:

means for supplying an image carrier with a developing agent to form a developed image;

means for transferring the developed image onto a recording medium;

means for removing the developing agent remaining on the image carrier after the image transfer by the transferring means;

means for storing the developing agent which is to be supplied to the image carrier by the supplying means;

means for receiving the developing agent removed by the removing means, the receiving means having a capacity which is less than or equal to 30% of the capacity of the storing means;

means for introducing the developing agent in the receiving means into the storing means, only when the amount of developing agent in the receiving means approaches the capacity of the receiving means; and means for integrally supporting the storing means, the receiving means and the introducing means, and supporting means being detachably fitted to the supplying means and the removing means.

7. An image forming apparatus comprising:

means for supplying an image carrier with a developing agent to form a developed image;

means for transferring the developed image onto a recording medium;

means for removing the developing agent remaining on the image carrier after the image transfer by the transferring means;

means for storing the developing agent which is to be supplied to the image carrier by the supplying means;

means, having a predetermined capacity, for receiving the developing agent removed by the removing means;

means for introducing the developing agent in the receiving means into the storing means, only when the amount of developing agent in the receiving means approaches the capacity of the receiving means, the introducing means including a one way valve for restricting movement of the development agent from the storing means to the receiving means and for allowing movement of the developing agent from the receiving means to the storing means; and means for integrally supporting the storing means, the receiving means and the introducing means, the supporting means being detachably fitted to the supplying means and the removing means.

8. An image forming apparatus comprising:

means for developing a latent image formed on an image carrier, by using a developing agent;

means for transferring the developed image onto a recording medium;

means for removing the developing agent remaining on the image carrier after the image transfer by the transfer means; and a developing agent processing unit detachably fitted to the developing means and the removing means, said processing unit including:

a first container having a storing portion storing the developing agent;

means arranged in the first container, for supplying the developing agent in the storing portion to the developing means;

a second container formed as one body with the first container, and including a recovery portion for receiving the developing agent removed by the removing means, the capacity of the recovery portion being 25% or less of the capacity of the storing portion;

means for stirring the developing agent received in the recovery portion;

a partition portion arranged at a boundary between the first container and the second container, for partitioning the storing portion and the recovery portion from each other;

a communication portion formed in the partition portion, for introducing, only when the amount of the developing agent received into the recovery portion approaches a capacity of the recovery portion, part of the developing agent into the storing portion; and means for preventing movement of the developing agent from the storing portion to the recovery portion through the communication portion.

9. An image forming apparatus comprising:

means for developing a latent image formed on an image carrier, by using a developing agent;

means for transferring the developed image onto a recording medium;

means for removing the developing agent remaining on the image carrier after the image transfer by the transfer means; and a developing agent processing unit detachably fitted to the developing means and the removing means, said processing unit including:

a first container having a storing portion storing the developing agent;

means arranged in the first container, for supplying the developing agent in the storing portion to the developing means;

a second container formed as one body with the first container, and including a recovery portion for receiving the developing agent removed by the removing means, the capacity of the recovery portion being 30% or less of the capacity of the storing portion;

means for stirring the developing agent received in the recovery portion;

a partition portion arranged at a boundary between the first container and the second container, for partitioning the storing portion and the recovery portion from each other;

a communication portion formed in the partition portion, for introducing, only when the amount of the developing agent received into the recovery portion approached a capacity of the recovery portion, part of the developing agent into the storing portion; and means for preventing movement of the developing agent from the storing portion to the recovery portion through the communication portion.

* * * * *